US005308179A

United States Patent [19]

Whitright

[11] Patent Number: 5,308,179

[45] Date of Patent: May 3, 1994

[54] WRITING INSTRUMENT

[75] Inventor: Curt E. Whitright, Chardon, Ohio

[73] Assignee: Novelty Creations, Inc., Chardon, Ohio

[21] Appl. No.: 979,664

[22] Filed: Nov. 20, 1992

[51] Int. Cl.[5] ..... B43K 29/00; B43K 9/00

[52] U.S. Cl. ..... 401/131; D19/46; D19/42; D19/57; D19/84; 401/202; 401/209; 401/213

[58] Field of Search ..... 401/209, 131, 202, 213; 40/334; D19/81, 82, 84, 42, 46, 57

[56] References Cited

U.S. PATENT DOCUMENTS

| | | | |
|---|---|---|---|
| D. 283,516 | 4/1986 | Huang | 401/209 X |
| D. 287,860 | 1/1987 | McShirley . | |
| D. 308,890 | 6/1990 | Wang . | |
| 558,733 | 4/1896 | Lathrop | 40/334 |
| 1,647,536 | 11/1927 | Miller . | |
| 2,215,084 | 9/1940 | Neal | 40/334 X |
| 2,237,883 | 4/1941 | Lipic | 40/334 |
| 2,591,874 | 4/1952 | Ritchie | 40/334 |
| 2,745,198 | 5/1956 | Nelson | 40/334 |
| 3,286,695 | 11/1966 | Martin | 401/131 |
| 3,804,538 | 4/1974 | Rosa | 401/209 |
| 4,016,982 | 4/1977 | Schreiber | 401/131 X |
| 4,678,206 | 7/1987 | Leahan | 40/334 X |
| 4,687,306 | 8/1987 | Lipson et al. . | |
| 4,728,212 | 3/1988 | Spector . | |
| 4,986,683 | 1/1991 | Whitright | 401/209 X |

*Primary Examiner*—Steven A. Bratlie

*Attorney, Agent, or Firm*—Oldham, Oldham & Wilson Co.

[57] ABSTRACT

A writing instrument shaped to resemble a flower on a stem with leaves comprised of a hollow tubing housing, a top portion of hollow tubing, an adapter for detachably connecting the top portion to the housing, and a stylus. One portion of the housing is curvilinear, having a plurality of loops shaped to resemble leaves. The top portion is shaped to resemble a flower or bud. The adapter allows the top portion to be detachably connected to either end of the housing. The overall effect is to suggest a flower or bud on a stem with leaves. A second embodiment of the writing instrument uses a base formed of hollow tubing bent into shapes to complement the flower and stem suggested by the housing and top portion. A third embodiment includes a plurality of top portions which are interchangeable and can be detachably connected to the housing using the same adapter.

19 Claims, 2 Drawing Sheets

WRITING INSTRUMENT

FIELD OF INVENTION

The present invention relates generally to writing instruments, and more specifically to writing instruments configured to resemble plants and preferably flowers.

BACKGROUND OF THE INVENTION

Various types of ornamental and utility writing instruments have been designed. One example of a novel writing instrument by Whitright, U.S. Pat. No. 4,986,683, which teaches a writing instrument contained in a hollow tube shaped to resemble an animal. Flexible colored materials are inserted into the tubing and other ornamental materials are attached to suggest eyes. Another embodiment of Whitright shows a base of hollow tubing which is curved to complement the appearance of the animal housing. Whitright also teaches placing a notepad in the upper portion of the writing instrument. Leahan, U.S. Pat. No. 4,678,206, shows a combination notepad and pen holder in which the pad is shaped as a flower. Huang, U.S. Pat. No. D283,516 shows the design for a pen with an elongated curvilinear tail piece.

Schreiber, U.S. Pat. No. 4,016,982, teaches an elongate holder which can be bent by hand into any desired shape. The holder consists of a core made of &,%xible metal which is surrounded by a flexible covering.

Lipson, U.S. Pat. No. 4,687,306, teaches an eyeglass frame formed from a continuous hollow transparent tube filled with a colored liquid.

None of these prior devices suggests a tubular 7riting instrument comprising a housing for a stylus which is formed in the shape of a stem with leaves and a tubular top portion shaped to resemble a flower which is detachably connected to either end of the housing with an adapter. None of the devices teach a plurality of tubular top portions which are interchangeably and detachably connected to a tubular housing.

SUMMARY OF THE INVENTION

The present invention includes a tubular housing which has a straight portion to contain a 7riting stylus and a curvilinear portion having loops and resembling leaves. A top portion, which is tubing formed in the shape of a flower or bud, is detachably connected to the housing at the end opposite of the stylus with an adapter. The adapter also allows the top portion to be connected to the stylus end of the housing to cover the stylus between uses. The overall effect of the shape of the writing instrument is to suggest a bud or flower on a plant stem with leaves.

Another embodiment adds a base which holds the writing instrument upright when placed on a horizontal surface such as a desk. The shape and color of the base is selected to complement the housing and the top portion.

A third embodiment includes a plurality of top portions which are interchangeable and can be detachably connected to a single housing using the same adapter.

DETAILED DESCRIPTION OF THE INVENTION

Figure 1:
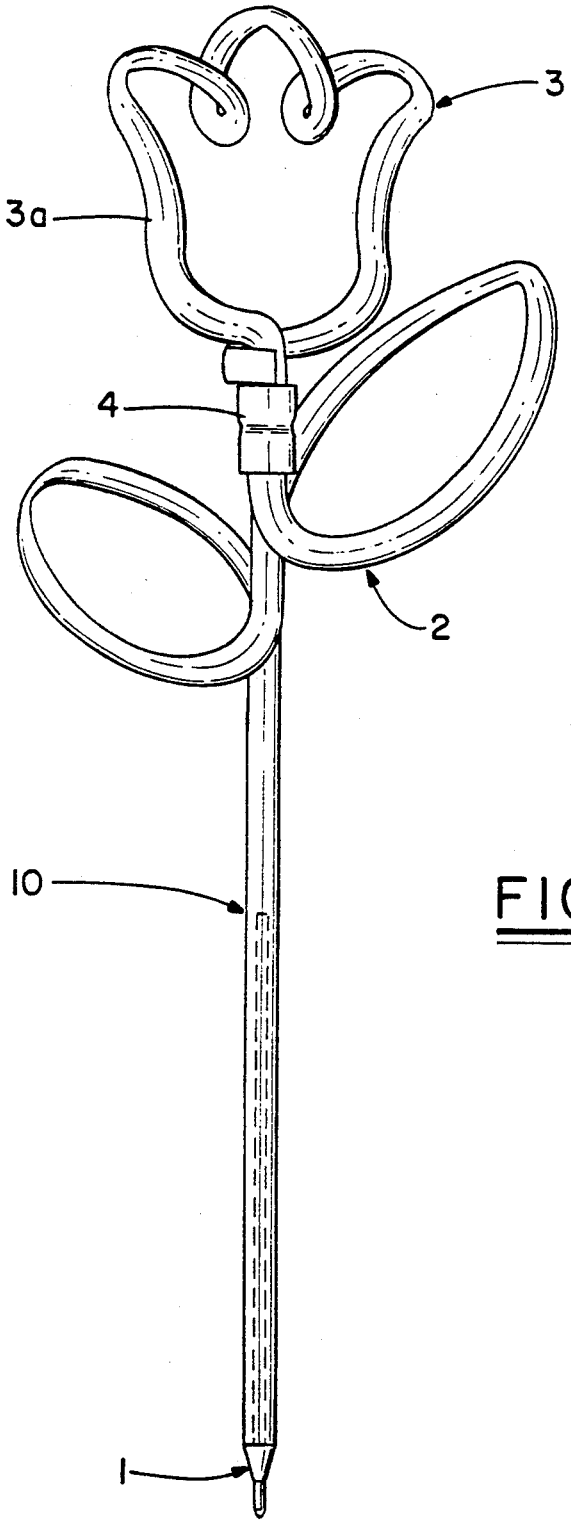
FIG. 1 is a front elevational view of a writing instrument according to this invention.

Referring to FIG. 1, the stylus instrument 1 of the present invention is contained within a continuous substantially rigid hollow tube or housing 10. The stylus instrument 1 can be a ball point pen, a pencil, a felt tip pen or any other type of writing instrument that can be adapted to fit 7ithin a hollow tube 10. The writing instrument 1 is inserted into the housing 10 and retained in position by friction or adhesive. The housing 10 is preferably an opaque solid color, such as green to mimic the color of a plant stem. The upper portion 2 of the housing 10 is shaped in curvilinear portions to form pleasing and attractive shapes. FIG. 1 shows the upper portion of the housing shaped to resemble leaves on a plant stem.

Figure 2:
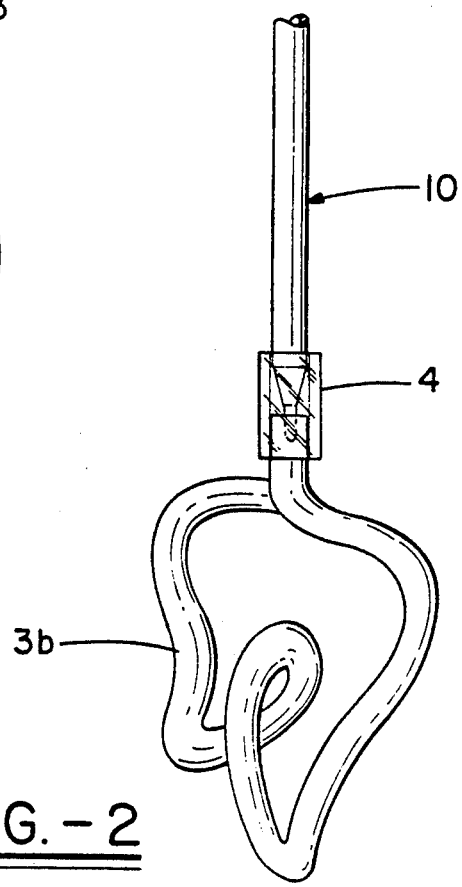
FIG. 2 is a front elevational view of the writing instrument of FIG. 1, showing the detachable top portion connected to the stylus end.

The top portion 3 is a continuous substantially rigid hollow tube formed into the shape of a flower as shown in FIGS. 1 and 2. The tube may be transparent or opaque in a solid color such as pink or red to suggest a flower. In an alternative embodiment, the tube may be sealed at each end and filled with a clear or colored liquid which may further contain flakes of colored or metallic material. The top portion 3 may be detachably connected with an adapter 4 as in FIGS. 1 and 2. The adapter 4 is a short tube made of elastic material such as rubber. The adapter 4 fits snugly over the end of the housing 10 and one end of the top portion 3. The adapter 4 also allows the top portion 3 to be detachably connected to the stylus end of the writing instrument to cover the stylus between uses as illustrated in FIG. 2. The overall effect of the straight and curvilinear portions of the housing and the top portion is to suggest a flower or bud on a stem with leaves.

Figure 3:
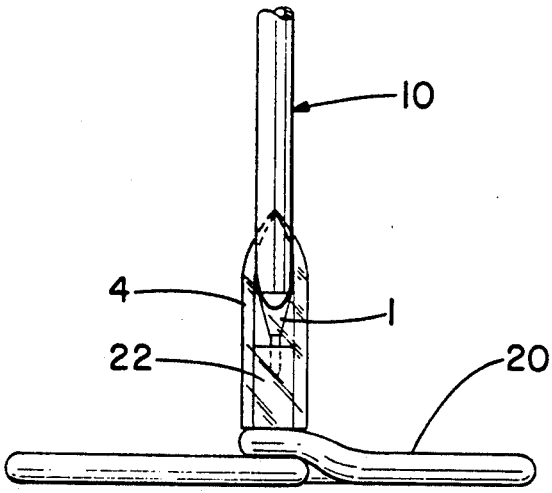
FIG. 3 is a front elevational view of the writing instrument showing a base for holding the writing instrument.
Figure 4:
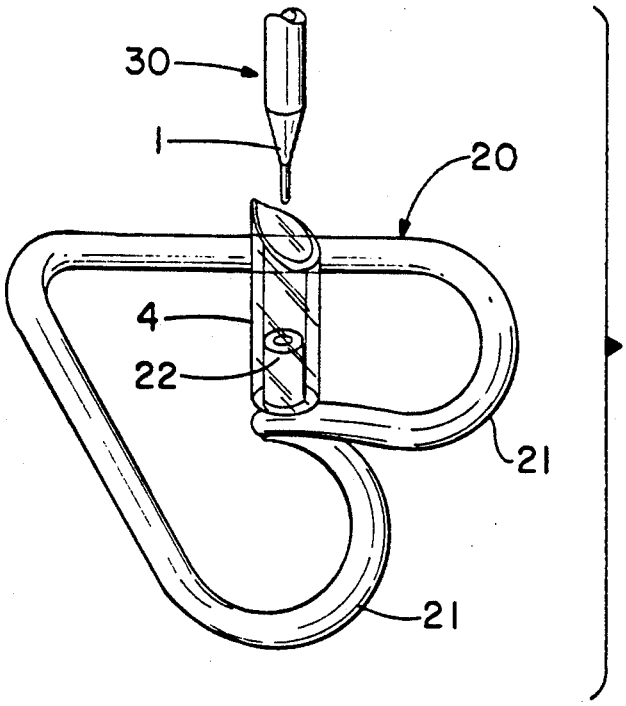
FIG. 4 is a perspective view of the embodiment shown in FIG. 3.

Another embodiment of the writing instrument is shown in FIGS. 3 and 4. This embodiment adds a base 20 to the invention described above. The base 20 is hollow tubing formed into a curved, horizontal member 21 and a non-horizontal member 22. The curved portion 21 forms a stable foundation to support the tubular writing instrument 30 in an upright position. A connector 23 is attached to the open end of the non-horizontal member 22. The tubular writing instrument 30 may be inserted into the connector 23 when not in use. It should be appreciated that base 20 could be made from a continuous length of tubing.

The curved portion 21 of the base 20 is preferably shaped to complement the overall shape of the writing instrument 30. FIG. 4 shows a base molded into a heart shape. The tubing of the base 20 may be transparent or opaque, in a color to complement the housing 10 and the top portion 3. Alternatively, the tubing of the base can be sealed so that the horizontal portion of the tubing could contain a liquid which may further include colored or metallic flakes, as described in connection with the top portion 4.

Figure 5:
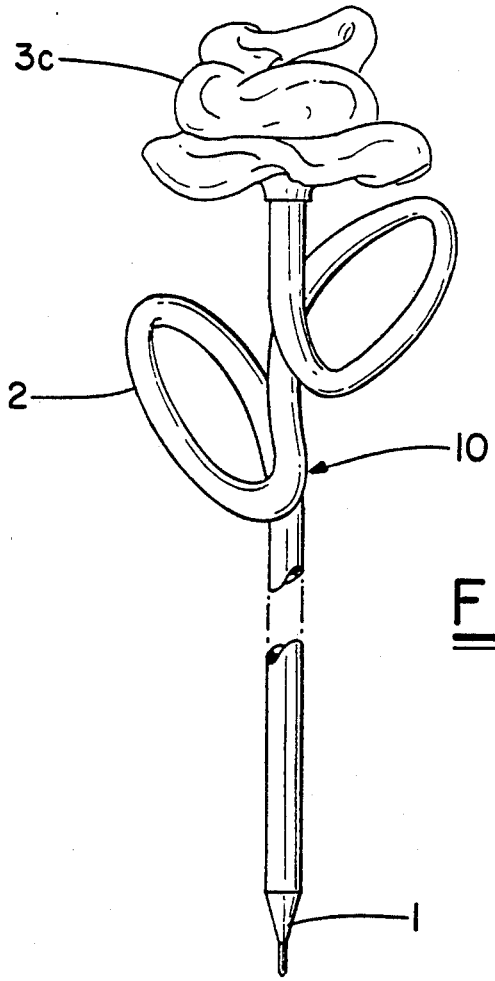
FIG. 5 is a front view of another embodiment of the writing instrument in combination with another interchangeable top portion.

FIGS. 1, 2 and 5 illustrate a plurality of top portions *3a*, *3b*, and *3c* respectively, resembling alternative flower designs. It should be appreciated that numerous varieties of buds, flowers and stems, presented as two or three dimensional, are possible by using the teachings of the present invention. The top portions *3a*–*3c* are detachably and interchangeably connected to the upper end of the housing 10 with a single adapter 4.

While in accordance with the patent statutes, a preferred embodiment and best mode has been presented, the scope of the invention is not limited thereto, but rather is measured by the scope of the attached claim.

I claim:

1. A writing instrument comprising:

a housing of substantially continuous, opaque and rigid hollow tubing, having a first and second end, said housing comprising at least a first region which is essentially straight and a second region which is curvilinear, said second region having a plurality of loops;

a stylus instrument inserted in the first end of said housing and extending outward therefrom;

a top portion of substantially rigid hollow tubing, molded into the shape of a flower, capable of attachment to the second end of said housing so as to complete an overall flower design in conjunction with said housing when said writing instrument is in use; and a connecting means for detachably connecting said top portion to said housing, said connecting means capable of detaching said top portion from said housing second end and reattaching said top portion at said housing first end to cover said stylus instrument.

2. A writing instrument according to claim 1 wherein said housing is molded into the shape of a plant stem and the curvilinear region of said housing resembles leaves on a plant stem.

3. A writing instrument according to claim 1 wherein said top portion is a generally transparent hermetically sealed tube.

4. A writing instrument according to claim 3 further comprising a liquid contained within said top portion.

5. A writing instrument according to claim 4 wherein said liquid comprises a generally transparent fluid mixed with flecks of colorful material.

6. A writing instrument according to claim 1 further comprising a stand of substantially rigid hollow tubing having a horizontal portion and a non-horizontal portion, said non-horizontal portion having a means located at its upper end for retaining said housing in a non-horizontal position and said horizontal portion being shaped so as to retain said housing in a non-horizontal position whenever said housing is inserted into said retaining means on said non-horizontal section.

7. A writing instrument according to claim 6 wherein the horizontal portion of said stand is curvilinear.

8. A writing instrument according to claim 6 wherein the horizontal portion /f said stand is a generally transparent, hermetically sealed tube.

9. A writing instrument according to claim 8 further comprising a liquid contained within said stand.

10. A writing instrument according to claim 9 wherein said liquid comprises a generally transparent fluid mixed with flecks of colorful material.

11. A writing instrument comprising:

a housing of substantially continuous, opaque and rigid hollow tubing, having a first end and a second end, said housing comprising at least a first region which is essentially straight and a second region which is curvilinear, said second region having a plurality of loops;

a stylus instrument inserted in the first end of said housing and extending /utward therefrom;

a plurality of top portions of substantially rigid hollow tubing shaped as flowers which are detachably and interchangeably connected to the second end of said housing so as to complete an overall flower design in conjunction with said housing when said writing instrument is in use; and a connecting means for detachably connecting at least one of said top portions to said housing, said connecting means capable of detaching said top portion from said housing second end and reattaching said top portion at said housing first end to cover said stylus instrument.

12. A writing instrument according to claim 11 wherein said housing is molded into the shape of a plant stem, and said curvilinear portion resembles leaves on a plant stem.

13. A writing instrument according to claim 11 further comprising a stand of substantially rigid hollow tubing having a horizontal portion and a non-horizontal portion, said horizontal portion being curvilinear and said non-horizontal portion having a means located at its upper end for retaining said housing in a non-horizontal position, said curvilinear portion of said horizontal portion being shaped so as to retain said housing in a non-horizontal position whenever said housing is inserted into said retaining means on said non-horizontal portion.

14. A writing instrument according to claim 13 wherein the horizontal portion of said stand is a generally transparent, hermetically sealed tube.

15. A writing instrument according to claim 14 further comprising a liquid contained within said sealed portion of said stand.

16. A writing instrument according to claim 15 wherein said liquid comprises a generally transparent fluid mixed with flecks of colorful material.

17. A writing instrument according to claim 11 7herein at least one of said plurality of top portions is a generally transparent hermetically sealed tube.

18. A writing instrument according to claim 17 further comprising a liquid contained in said sealed top portion.

19. A writing instrument according to claim 18 wherein said liquid comprises a generally transparent fluid mixed with flecks of colorful material.

* * * * *